US005853797A

United States Patent [19]

Fuchs et al.

[11] Patent Number: 5,853,797

[45] Date of Patent: Dec. 29, 1998

[54] METHOD OF PROVIDING CORROSION PROTECTION

[75] Inventors: Harold E. Fuchs, Kansas City, Mo.; Henry Hon Law, Berkeley Heights, N.J.; Daniel George Muth, Leawood, Kans.

[73] Assignee: Lucent Technologies, Inc., Murray Hill, N.J.

[21] Appl. No.: 941,250

[22] Filed: Sep. 30, 1997

Related U.S. Application Data

[63] Continuation of Ser. No. 560,694, Nov. 20, 1995, abandoned.

[51] Int. Cl.[6] ..... B05D 7/14

[52] U.S. Cl. ..... 427/96; 427/384; 427/435; 427/443; 106/14.26; 106/14.27; 106/14.41; 562/8; 558/214

[56] References Cited

U.S. PATENT DOCUMENTS

| | | | |
|---|---|---|---|
| 3,318,915 | 5/1967 | Hasserodt et al. | 260/345.9 |
| 3,630,790 | 12/1971 | Schmidt et al. | 106/14 |
| 3,704,107 | 11/1972 | Schlicht et al | 44/58 |
| 3,812,222 | 5/1974 | Kleiner et al. | 260/970 |
| 3,900,370 | 8/1975 | Germscheid et al. | 204/38 A |
| 4,293,441 | 10/1981 | Newell et al. | 252/389 A |
| 4,663,061 | 5/1987 | Kuwamoto et al. | 252/32.5 |
| 5,178,916 | 1/1993 | Chidsey et al. | 427/343 |
| 5,366,646 | 11/1994 | Sato et al. | 252/49.8 |

OTHER PUBLICATIONS

Dabosi et al, J. Applied Electro Chemistry 21 (1991), 255–260.

Holden et al, IEEE Trans, Components, Hybrids and Manufacturing Technology, 12(1), Mar. 1988, 64–70.

*Primary Examiner*—Erma Cameron

[57] ABSTRACT

Disclosed is a method and solution for providing corrosion protection for electrical contact members. The contact members are exposed to the solution, which in one embodiment includes a phosphonate, a lubricant, and a solvent. In a preferred embodiment, the phosphonate is phosphonic acid, the lubricant is polyphenyl ether or tricresylphosphate, and the solvent includes an isoparaffinic hydrocarbon. In a further embodiment, the lubricant can be omitted from the solution.

11 Claims, 1 Drawing Sheet

METHOD OF PROVIDING CORROSION PROTECTION

This is a Continuation of application Ser. No. 08/560,694 filed Nov. 20, 1995, now abandoned.

BACKGROUND OF THE INVENTION

This invention relates to electrical contact members and, in particular, to a method and material for preventing corrosion of such members.

In many interconnection systems, electrical contact members, such as conductive pins inserted within a backplane, may be made from a metal such as a copper-nickel alloy and coated with a very thin layer of gold, typically 0.1 to 2 micrometers. The thin gold layer may be porous, and, consequently, some solution is usually applied to prevent corrosion. One promising technique is described in U.S. Pat. No. 5,178,916 issued to Chidsey et al., incorporated by reference herein, where a phosphonate solution is applied to the contact members. The solution may include phosphonic acids and their salts, or monoesters of phosphoric acids and their salts, dissolved in an alcohol such as ethanol. The preferred phosphonate was a fluorinated phosphonic acid dissolved in ethanol with the contact members immersed in the solution for approximately 15 minutes. It is also stated that the solution can be used as a lubricant or as a trace element in a carrier such as wax, fine oil, motor oil, or detergent.

In the fabrication of such contact members, it is desirable to reduce the soak time as much as possible to provide an economical factory process. It is important not only to prevent corrosion but also to lubricate the members for easy connection to other components and to provide the corrosion inhibitor and lubricant in one step. Further, it is desirable that the resulting member be essentially free of corrosion after exposure to a four gas mixture ($NO_2$, $Cl_2$, $H_2S$, and $SO_2$) to qualify the members for use in telecommunications systems as required by *Bellcore Generic Requirements for Separable Electrical Connectors Used in Telecommunications Hardware,* TR-NWT-001217, Issue No. 1, September, 1992. A further less stringent requirement is that the members pass the IEC $K_e$ Method C Test for European use which involves exposure to a two gas mixture ($H_2S$ and $SO_2$).

SUMMARY OF THE INVENTION

The invention in one aspect is a method for treating electrical contact members. The members are exposed to a solution consisting essentially of a phosphonate, a lubricant, and a solvent having a flash point above 49 degrees C. In a preferred embodiment, the solution consists essentially of a phosphonic acid, a polyphenyl ether lubricant, and an isoparaffinic solvent.

In accordance with another aspect of the invention, the members are exposed to a solution which consists essentially of a phosphonic acid having the formula $CH_3\ (CH_2)_nPH_2\ O_3$, where n is in the range 5–13, and a solvent.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION OF THE INVENTION

Figure 1:
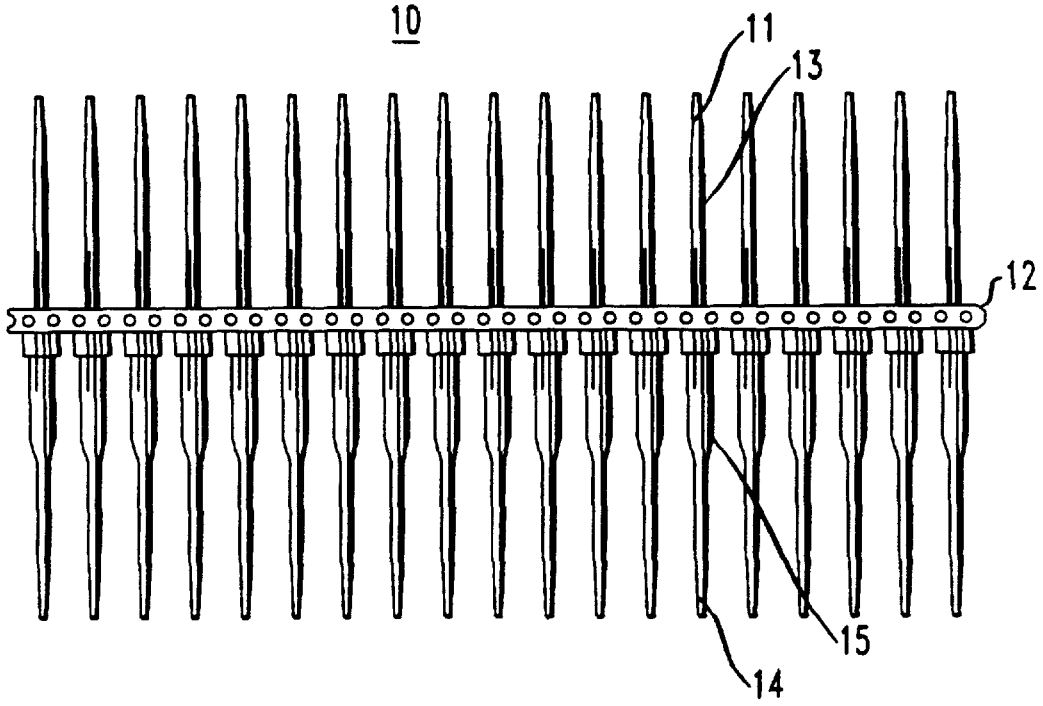
FIG. 1 is a plan view of an array of contact members which may be treated in accordance with an embodiment of the invention.

FIG. 1 illustrates a portion of an array of contact members which may be treated for corrosion protection. The array, 10, includes identical conductive pins, 11, which in this example are made of a copper-nickel-tin alloy. The pins are joined by a bar, 12, during processing, but the pins are separated by cutting the bar before mounting in a backplane (not shown). Each pin, 11, includes an end, 13, which is designed to receive a connector from a component (not shown) and an opposite end, 14, which is designed for wire wrapping. A compliant portion, 15, is also included on each pin for mounting the pin within a hole in the backplane. Both ends of each pin are coated with a layer of nickel which is 1.5 to 5 $\mu$m thick and then coated with a thin layer of gold, which is typically 1.4 $\mu$m thick. The gold layer typically extends approximately 0.75 to 1.5 cm from the ends.

Figure 2:
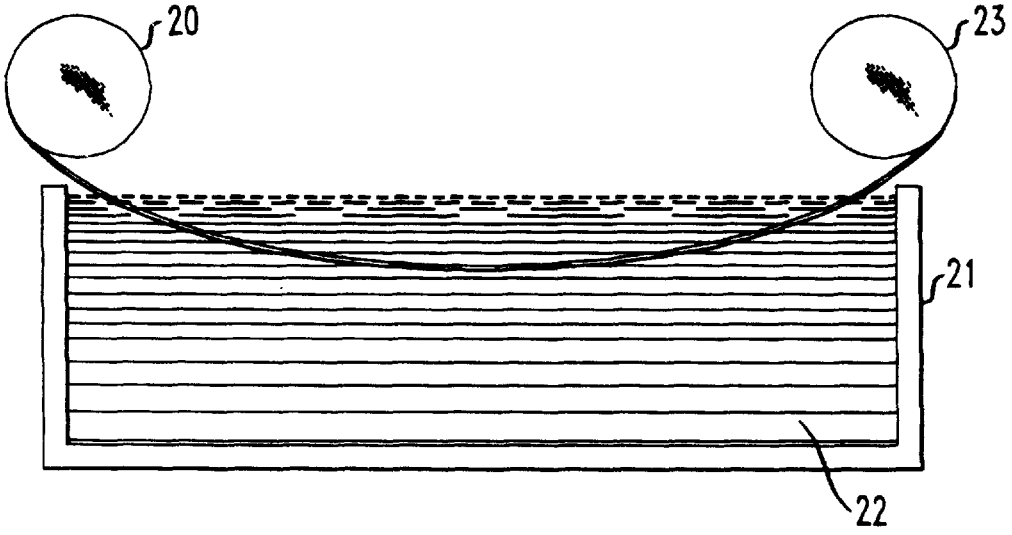
FIG. 2 is a schematic illustration of a treatment in accordance with an embodiment of the invention.

Corrosion protection may be provided for each pin by the step illustrated schematically in FIG. 2. The pin array is unrolled from a spool, 20, and drawn into a tank, 21, which includes a solution, 22, to be described. The array is taken up by another spool, 23, at a rate such that each pin will be submerged in the solution, 22, for a period of time preferably in the range 1 to 15 seconds. Although FIG. 2 illustrates the pins being inserted in a horizontal direction, in the cases where it is desired to keep the solution, 22, away from the compliant portion, 15, the pins can be inserted vertically to treat only the ends of the pins. Alternatively, the pins could first be inserted into a backplane and the ends dipped into the solution, 22. Further, it may be possible to spray the solution onto the pins.

The solution, 22, in accordance with an embodiment of the invention consists essentially of three components: a phosphonate compound, a lubricant, and a solvent. The phosphonate can include any material having the formula:

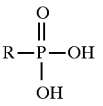

where R can be any long chain polymer and the H ions can be replaced by sodium or potassium to produce a phosphonate salt. Presently preferred are phosphonic acids, where R is $CH_3(CH_2)_n$ and n is in the range 5 to 13. The lubricant may be any standard material which is used to lubricate contact members and which does not adversely affect the corrosion inhibitor. One particularly effective lubricant is polyphenyl ether which, for example, is sold by Monsanto under the designation OS124 or OS138 lubricant. Another effective lubricant is tricresylphosphate which is sold in a solvent of polyolesters by Akzo under the designation CL920 lubricant. The solvent should be a material which dissolves the phosphonate and lubricant, and has a flash point above 49 degrees C. Presently preferred is an isoparaffinic hydrocarbon solvent, which for example, is sold by Exxon under the trademark Isopar H. In addition, as described below, octanol may be added along with the isoparaffinic as a solvent.

In general, the range of concentration of the phosphonate should be 0.01 to 10 weight percent. Concentrations of less than 0.01 percent will probably not be effective in corrosion protection, while concentrations above 10 weight percent tend to result in a material with too high a viscosity to be useful for most applications. The range of concentration for the lubricant is generally 1 to 2 weight percent.

In accordance with another embodiment, the solution, 22, consists essentially of a phosphonic acid having the formula $CH_3(CH_2)PH_2O_3$ where n is in the range 5–13, and a solvent. Such a solution permits immersion of the pins for a very small period of time (30 seconds or less).

Further details of the invention are given in the following examples. In all examples, conductive pins as shown in FIG. 1 were first vapor degreased and water rinsed. One batch was used as a control and other batches were treated in the manner described.

EXAMPLE 1

The corrosion inhibitor was prepared by mixing 6.15 grams of n-dodecylphosphonic acid and 5.97 grams of polyphenyl ether (OS 124) with 500 ml of isoparaffinic hydrocarbon solvent (Isopar H) and heating the mixture to 55–60 degrees C. to dissolve the phosphonic acid. The pins were immersed for 2 seconds and dried by baking in an oven at a temperature of 85–90 degrees C. for 2 minutes.

In one test, the treated pins were aged at 100 degrees C. for 14 days in air. Ten contact resistance measurements were made on each of ten pins with a contact force of 23 grams. The contact resistance of the treated pins both before and after aging was comparable to the control pins, indicating that the inhibitor did not adversely affect the performance of the pins.

In a second test, both the control and treated pins were exposed to an environment of 200 ppb $NO_2$, 20 ppb $Cl_2$, 100 ppb $H_2S$, and 200 ppb $SO_2$, the remainder air, for 10 days in accordance with the Bellcore Specifications cited previously. A portion of the pins was exposed in an open (unmated) configuration, and a portion was exposed in a closed configuration (mated with a connector). Visually, all the treated pins retained their pristine gold condition, while the control pins were covered with corrosion products. Further, contact resistance measurements were made of the treated and control pins both before and after exposure to the gases. The control pins went from a contact resistance of 3.5 to 4 milliohms before exposure to greater than 300 milliohms after exposure. However, the treated pins went from 4 to 4.4 milliohms before exposure to only 5 to 5.5 milliohms after exposure. This result confirmed that all treated pins were protected from corrosion.

The treated pins were also exposed to an environment of $H_2S$ and $SO_2$ in accordance with the IEC $K_e$ Method C Standard for European use with similar results.

EXAMPLE 2

Essentially, the same procedures as in Example 1 were followed except that an 8 carbon chain phosphonic acid was substituted for the 12 carbon chain phosphonic acid. Specifically, the solution was prepared by mixing 6.28 grams of n-octylphosphonic acid and 7.59 grams of the polyphenyl ether and brought up to 500 ml with the isoparaffinic hydrocarbon solvent.

Results similar to those in Example 1 were obtained

EXAMPLE 3

Essentially, the same procedures as described in Example 1 were followed except that a 10 carbon chain phosphonic acid was used in place of the 12 carbon chain phosphonic acid. Specifically, the solution was prepared by mixing 6.29 grams of n-decylphosphonic acid and 7.36 grams of the polyphenyl ether brought up to 500 ml with the isoparaffinic hydrocarbon solvent.

Results similar to those in Example 1 were obtained.

EXAMPLE 4

Essentially, the same procedures as described in Example 3 were followed except that octanol was added as an additional solvent. Specifically, 2.5 grams of n-decylphosphonic acid was dissolved in 25 ml of octanol and then 2.5 grams of the polyphenyl ether was mixed with the octanol solution. The solution was brought up to 250 ml by the addition of the isoparaffinic hydrocarbon.

Results similar to those in Example 3 were obtained.

EXAMPLE 5

Essentially, the same procedures as described in Example 4 were followed except that a mixture of polyolesters and tricresylphosphate (CL920) was substituted for polyphenyl ether as the lubricant. Specifically, 2.7 grams of n-decylphosphonic acid was dissolved in 25 ml of octanol. Then, 5.03 grams of CL920 was mixed with the octanol solution. The resulting solution was brought up to 250 ml with the isoparaffinic hydrocarbon.

Results similar to those in Example 3 were obtained.

EXAMPLE 6

Essentially, the same procedures as described in Example 4 were followed except that no lubricant was added to the solution. Specifically, 2.56 grams of n-decylphosphonic acid was dissolved in 25 ml of octanol and the solution was brought up to 250 ml by the addition of the isoparaffinic hydrocarbon.

Results similar to those in Example 1 were obtained. While the solution did not provide the benefit of a lubricant, the procedure was advantageous in the low soak time (approximately 2 seconds) required to achieve corrosion protection.

EXAMPLE 7

Essentially, the same procedures as described in Example 6 were followed except that a liquid form of n-decylphosphonic acid was used in place of the standard solid form. Specifically, 2.5 grams of liquid n-decylphosphonic acid was brought up to 250 ml by the addition of the isoparaffinic hydrocarbon.

While the corrosion results using the liquid phosphonic acid to form the solution were not as good as when the solid phosphonic acid was used, acceptable corrosion protection was achieved. Further experiments confirmed that the liquid form could also be used in solutions which included a lubricant.

In general, it is recommended that the contact members be immersed in the solution for a period in the range 1 to 30 seconds, and that the solution be maintained at a temperature within the range 20 to 60 degrees C.

It will be appreciated that, in general, the invention involves using a solution consisting essentially of a phosphonate compound, a lubricant, and a solvent. The phosphonate can be phosphonic acid, an ester of phosphonic acid, or a salt of phosphonic acid. Preferable, the phosphonate is phosphonic acid having the formula $CH_3(CH_2)_nPH_2O_3$ where n is within the range 5 to 13. The lubricant is preferably selected from the group consisting of polyphenyl ether and tricresylphosphate (CL920). The solvent is preferably an isoparaffinic hydrocarbon alone or in combination with octanol and polyolesters. In cases where the phosphonate is $CH_3(CH_2)_nPH_2O_3$, a low soak time can be achieved. Consequently, the lubricant can be omitted while still achieving desirable results. The $CH_3(CH_2)_nPH_2O_3$ can be initially in solid or liquid form.

The invention claimed is:

1. A method for treating electrical contact members for corrosion protection comprising exposing the members to a solution consisting essentially of a phosphonate, a lubricant, and a solvent having a flash point above 49 degrees C., wherein the lubricant is not a phosphonate material.

2. The method according to claim 1, wherein the phosphonate is selected from a group consisting of phosphonic acids, esters of phosphonic acids, and salts thereof.

3. The method according to claim 1, wherein the phosphonate is a phosphonic acid having a formula $CH_3(CH_2)_nPH_2O_3$, where n is in a range of 5 to 13.

4. A method for treating electrical contact members for corrosion protection comprising exposing the members to a solution consisting essentially of phosphonic acid having the formula $CH_3(CH_2)_nPH_2O_3$, where n is in a range of 5–13, and a solvent, wherein the solvent comprises an isoparaffinic hydrocarbon and, optionally one of octanol and polyolesters.

5. The method according to claims 3 or 4, wherein a concentration of the phosphonic acid is within a range of 0.01 to 10 weight percent.

6. The method according to claim 3, wherein the lubricant is selected from a group consisting of polyphenyl ether and tricresylphosphate.

7. The method according to claim 3, wherein the solvent comprises an isoparaffinic hydrocarbon.

8. The method according to claim 7, wherein the solvent further comprises octanol.

9. The method according to claims 1 or 4, wherein the contact members comprise conductive pins having one end which is matable with a connector and an opposite end which is adapted for wire wrapping.

10. The method according to claims 1 or 4, wherein the members are exposed by immersing in the solution for a period in a range of 1 to 30 seconds.

11. The method according to claim 1, wherein the solution is heated to a temperature with a range of 20 to 60 degrees C.

* * * * *

UNITED STATES PATENT AND TRADEMARK OFFICE

CERTIFICATE OF CORRECTION

PATENT NO. : 5,853,797

DATED : December 29, 1998

INVENTOR(S) : Harold E. FUCHS, Henry Hon LAW and Daniel George MUTH

It is certified that error appears in the above-indentified patent and that said Letters Patent is hereby corrected as shown below: On the title page:

Item [73], add --Berg Technology, Inc., Reno, NV--.

Signed and Sealed this

Ninth Day of November, 1999

*Attest:*

Q. TODD DICKINSON

*Attesting Officer*

*Acting Commissioner of Patents and Trademarks*